US009574848B2

(12) United States Patent
Zimmermann

(10) Patent No.: US 9,574,848 B2
(45) Date of Patent: Feb. 21, 2017

(54) SIGHT

(71) Applicant: Swarovski-Optik KG., Absam (AT)

(72) Inventor: Andreas Zimmermann, Fulpmes (AT)

(73) Assignee: Swarovski-Optik KG. (AT)

( * ) Notice: Subject to any disclaimer, the term of this patent is extended or adjusted under 35 U.S.C. 154(b) by 0 days.

(21) Appl. No.: 14/136,676

(22) Filed: Dec. 20, 2013

(65) Prior Publication Data

US 2014/0202059 A1 Jul. 24, 2014

(30) Foreign Application Priority Data

Jan. 8, 2013 (AT) ..... A 50003/2013

(51) Int. Cl.
*F41G 1/00* (2006.01)
*F41G 1/38* (2006.01)
*F41G 1/473* (2006.01)

(52) U.S. Cl.
CPC ..... *F41G 1/38* (2013.01); *F41G 1/473* (2013.01)

(58) Field of Classification Search
CPC ..... F41G 1/38; F41G 1/473
See application file for complete search history.

(56) References Cited

U.S. PATENT DOCUMENTS

| | | | | |
|---|---|---|---|---|
| 4,561,204 | A * | 12/1985 | Binion | 42/122 |
| 6,519,890 | B1 * | 2/2003 | Otteman | 42/122 |
| 7,793,456 | B1 | 9/2010 | Lacorte | |
| 8,468,930 | B1 * | 6/2013 | Bell | 89/204 |
| 2007/0277421 | A1 * | 12/2007 | Perkins et al. | 42/122 |
| 2009/0205239 | A1 * | 8/2009 | Smith, III | 42/122 |
| 2010/0157292 | A1 * | 6/2010 | Tsai et al. | 356/247 |
| 2012/0000979 | A1 * | 1/2012 | Horvath et al. | 235/407 |
| 2012/0042559 | A1 | 2/2012 | Bockmon | |
| 2012/0182417 | A1 * | 7/2012 | Everett | 348/135 |
| 2012/0195023 | A1 * | 8/2012 | Tang et al. | 362/85 |
| 2012/0297658 | A1 * | 11/2012 | Lupher et al. | 42/69.01 |
| 2013/0199074 | A1 * | 8/2013 | Paterson et al. | 42/122 |
| 2014/0115942 | A1 * | 5/2014 | Plaster | 42/126 |

FOREIGN PATENT DOCUMENTS

DE 102008053948 A1 5/2009

* cited by examiner

*Primary Examiner* — Gabriel Klein
(74) *Attorney, Agent, or Firm* — Lerner, David, Littenberg, Krumholz & Mentlik, LLP

(57) ABSTRACT

The invention relates to a sighting device having an optical reversing system (12) and a target mark as well as a ballistics computer for computing data that is relevant in terms of ballistics, the reversing system (12) being adjustable mechanically and the target mark being adjustable electronically and at least one adjusting device (13) being provided for adjusting the reversing system (12) and the target mark.

19 Claims, 5 Drawing Sheets

SIGHT

Figure 1:
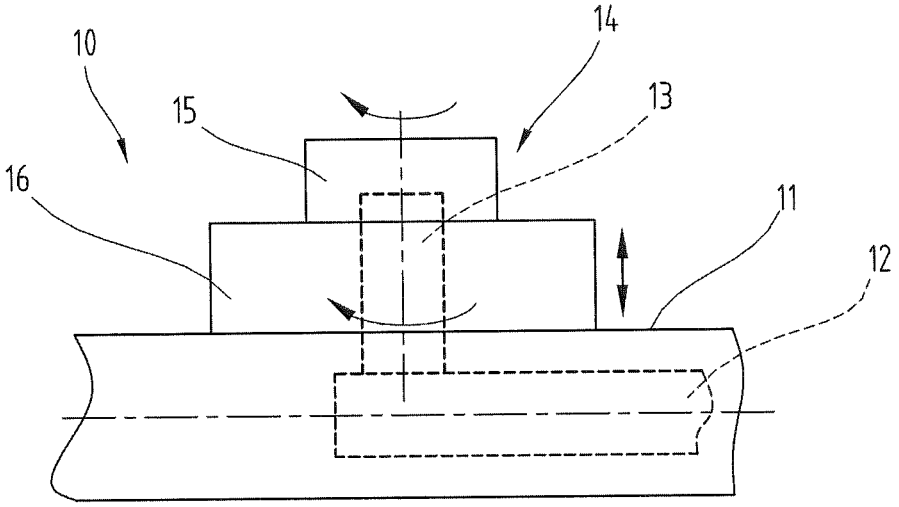

The invention relates to a sighting device, in particular a sighting telescope or rifle sight, according to the preamble of independent claim 1.

In the last years, sighting devices have been developed in such a way that not only the adjustment possibilities for the usual reversing system or for a reticule (target point) of the sighting devices have been improved, in particular for rifle sights, but sighting devices have been developed which provide the user with exact ballistic data. These shall help to improve the target acquisition. Thus, rifle sights have become known, which can be connected to a ballistics computer or which exhibit such a computer.

Those ballistics computers may, on the one hand, be connected to sensors transmitting the data relevant in terms of ballistics directly to the ballistics computer, or they may, on the other hand, also exhibit an input device by means of which the corresponding data is entered into the ballistics computer. By way of this ballistic data, a possible target may be perceived via the sighting device more easily. The ballistic data mainly include the target range, wind speed and also the caliber and the assembly of the ammunition used. Additional data might also be of relevance.

In addition to the sighting devices having ballistics computers, nowadays' common rifle sights are already equipped with several adjustment means that are used for focusing at the target range (parallax adjustment), for adjusting the reversing system (displacement of impact point) or also for switching the reticule illumination on and off. For this purpose, the rifle sights are frequently equipped with an elevation turret and at least one windage turret (including adjustment means for displacement of impact point), which turrets are provided with additional adjustment means. It is alternatively possible that also a further windage turret is provided, by means of which it is e.g. possible to control the illumination of the reticule.

Rifle sights equipped with a ballistics computer are operated via the ballistics computer itself, provided that the latter offers the possibility to enter different data. As rifle sights do not have much space for additional functions, such as input means, these are frequently only associated with the rifle sights and not integrated in the latter, so that the operation is not carried out directly at the sighting device. This is in particular disadvantageous with rifle sights which are mounted on a weapon, since the user cannot easily operate all functions of the sighting device when the weapon is in shooting position.

It is therefore the objective of the present invention to develop the abovementioned sighting device and to propose an input means for a rifle sight which can be operated intuitively when being in shooting position.

A sighting device for achieving the objective according to the invention exhibits the characteristics of independent claim 1. According to this, a sighting device, in particular sighting telescope or rifle sight, is proposed which has an optical reversing system, at least one target mark as well as a ballistics computer for computing the relevant data in terms of ballistics, and the reversing system and a target mark may be adjusted mechanically, and the target mark may, additionally, be adjusted electronically, and at least one adjusting device being provided for adjusting the reversing system and the target mark. By means of such a sighting device, it is possible for the first time to control substantially any relevant parameters which are required for target acquisition or for adjusting the sighting device by means of only one adjusting element. In this case, it shall in particular be possible to adjust the reversing system not only mechanically, but also to operate the ballistics computer by means of the same adjusting element. The user is therefore not required to get used to new circumstances, and may—as he is used to do—adjust the substantial parameters via an adjusting device situated at the usual place of the sighting device.

According to a preferred embodiment of the invention, one respective adjusting element may be provided for each, the adjusting of the reversing system and of the target mark, the two adjusting elements being arranged to be adjacent, in particular directly adjacent, to each other. One adjusting element for each, for mechanical and electronic adjustment, or for adjusting the sighting device may be of help for differentiation, causing that the user does not unintentionally adjusts the reversing system, although he actually wanted to enter data into the ballistics computer. It is, however, preferred that the two adjusting elements are situated to be directly adjacent to each other, so that the user is does not have to change the position of the hands when he wants to use both adjusting elements successively.

It is particularly advantageous if the adjusting elements are arranged on a turret of the sighting device and can be operated independently of one another. The turret is a device the user is used to, by means of which he can adjust the rifle sight. Therefore, the arrangement of the two adjusting elements, in particular of the adjusting element for the electronic input of ballistic data into the ballistics computer is advantageous. There is neither the need for the user to get used to something new, nor is he required to change the position of his hands or to put down the weapon in order to be able to operate the ballistics computer.

It may particularly advantageously be provided for this purpose, if the adjusting elements are arranged on an elevation turret or on a windage turret of the sighting device. The user of the sighting device is familiar with these two turrets from conventional sighting devices, for which reason he is not required to get used to additional separate adjusting means.

According to a particularly advantageous embodiment of the invention, it is preferably possible for at least one of the adjusting elements to be rotated, tilted and height adjusted at the same time. Due to the arrangement of the adjusting elements according to the invention, a special comfort is guaranteed for the user, for which reason all functions of the ballistics computer shall be operated via the adjustment element, in particular that one provided for the operation of the ballistics computer. To this end, a plurality of different possibilities for moving the adjusting device may be necessary, in order to enable the user to operate an input program easily in an intuitive manner. In addition to the three directions of movement, the adjusting element can also be moved starting from its axial position on the turret.

According to an advantageous embodiment of the invention, the two adjusting elements may be arranged one upon the other on the respective turret in axial direction of the turret, and it is preferred that the lower adjusting element has a greater circumference that the upper adjusting element. The arrangement in a way that one adjusting element is situated upon the other is very suitable as the adjusting elements may be embodied as rings or discs. For haptic reasons, it may furthermore be advantageous that both adjusting elements differ. This can, on the one hand, be realized by a special ribbing at the circumferential face or by a different size, on the other hand. It is additionally easier to grip a greater lower adjusting element, too, as this is disposed to be closer to a tube of the sighting device. Furthermore, the lower adjusting element can be embodied to be thicker or thinner.

For this purpose, it may additionally be advantageous that the upper adjusting element is provided for mechanically adjusting the reversing system and the lower adjusting element is provided for entering the data into a ballistics computer. So, the adjusting element used for mechanically adjusting the reversing system remains at the place on the turret the user is familiar with, for which reason he is not required to get used to a new position.

According to an advantageous exemplary embodiment of the invention it may be provided that target range, wind direction, wind speed, firing angle, assembly of ammunition and any other data that is relevant in terms of ballistics, or any other data, which is not relevant in terms of ballistics, such as illumination brightness of the target mark, illumination color or design of target mark, is entered into the ballistics computer. Using these and other parameters, the target acquisition may be simplified, and the ballistics computer can also evaluate the entered values.

It is particularly advantageous that the target mark may be adjusted by means of the ballistics computer. Different ballistic data may be consulted for the adjustment of the target mark. In the simplest case, a range to the target is to be entered via the adjusting element, with the result that the target mark is getting modified. In the event that the sighting device has an internal range finder or is connected to an external range finder, this process may also be carried out automatically.

According to another advantageous embodiment, several target marks may be provided, which target marks can in particular be illuminated each solitarily or at least partially together. The term target mark may be used as a synonym for the common reticule (line image), and several target marks may be provided if, e.g. a reticule is provided in the lens-end image plane (first image plane) and another reticule is provided in the eyepiece-end image plane (second image plane). Moreover, the term target mark may be used, additionally but not exclusively, within the meaning of an aiming point which is provided in the sighting device. Such target marks may be illuminated. On the one hand, in order to improve an optic in low visibility conditions, and, on the other hand, to show the target mark to be used for correct target acquisition to the user.

It may furthermore be advantageously provided that the target marks may be illuminated depending on the ballistic data entered and/or computed. In the simplest case, the target marks are illuminated depending on the target range, for which reason the one or other target mark is illuminated depending on distance. The distance may either be entered manually or calculated by means of the range finder. The same applies to further ballistic data, too.

It is furthermore particularly preferred that the target marks can be illuminated depending on a position of the reversing system, the position (tilt) of the reversing system being recognized by in particular a position recognition device and transmitted to the ballistics computer. Due to the mechanical adjustment (tilt) of the reversing system, the target acquisition remains constant in one position of the sighting device (e.g. center of the reticule, central aiming point) within the target mark (reticule). Thereby, the user can adjust the sighting device corresponding to the target range via the reversing system, the target mark and, in particular, the aiming point remain in the same position in this case. When the target is, however, acquired via the variable target marks, the target mark in the form of an aiming point is modified by displacing the aiming point on the reticule, for which reason the variable target marks can be adapted when the reversing system is adjusted.

Moreover, according to another advantageous embodiment of the invention, the target mark, in particular if the target mark is not centrally arranged (in the middle) in the second image plane, can be adjusted depending on a predetermined magnification of the sighting device, in particular the computing of the data relevant in terms of ballistics can be effected as a function of the magnification. Unless the target mark changes together with the different magnification of the sighting device, it may be required for the target mark to be adapted accordingly and furthermore for ballistic data to be computed in a different way.

According to a special embodiment of the invention, data, in particular data relevant in terms of ballistics, can be displayed within the target mark. Thereby, the user can be provided with information on, on the one hand, the program choice of the ballistics computer, and retrieve, on the other hand, important information from the latter. It is conceivable that several pieces of information are simultaneously displayed in the sighting device or the target mark.

Further advantageous embodiments of the present invention are described in the dependent claims.

For a better understanding of the invention the latter is explained in more detail with reference to the following figures.

Figure 2:
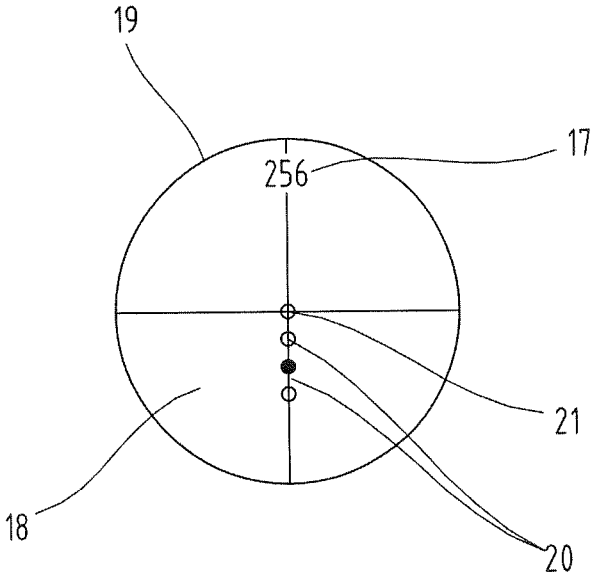
Figure 3:
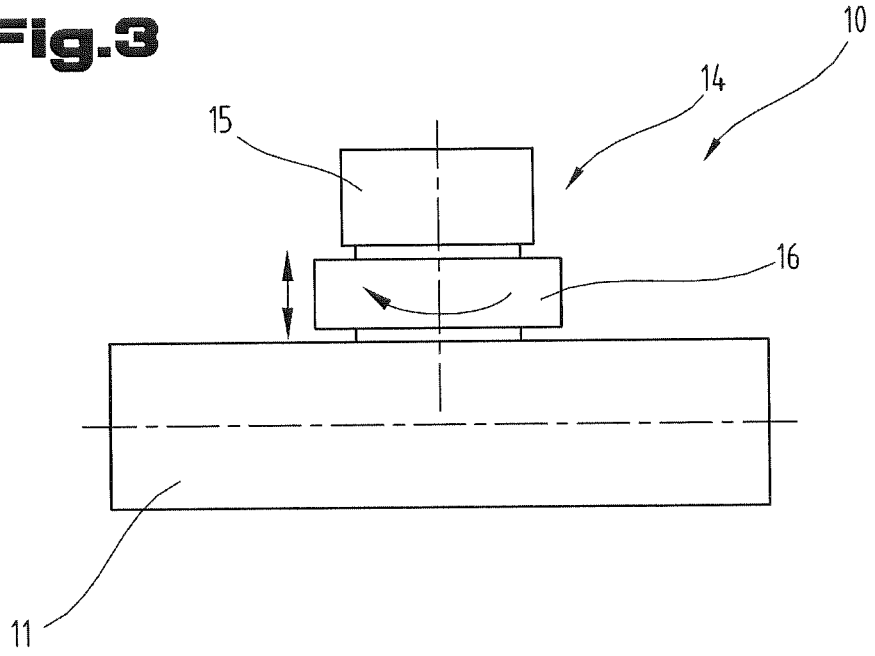
Figure 4:
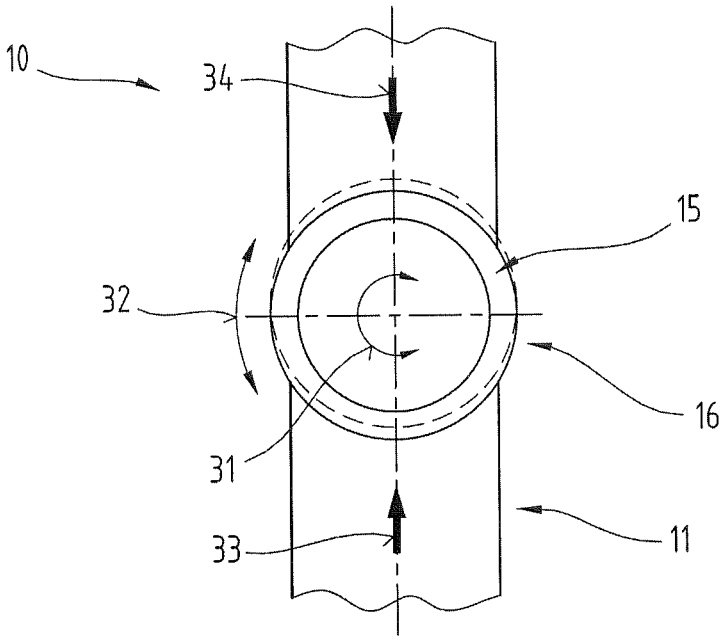
Figure 5:
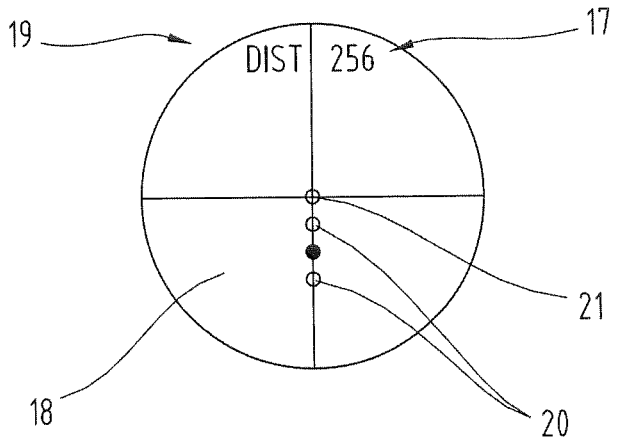
Figure 6:
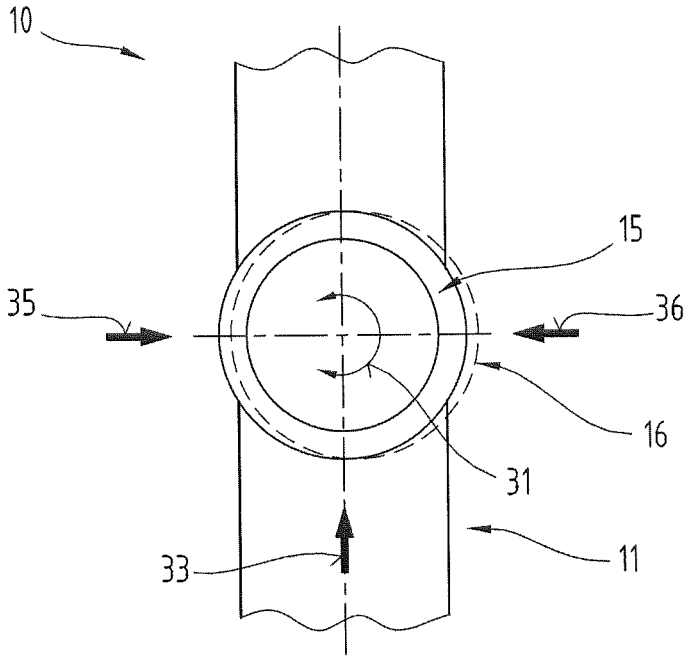
Figure 7:
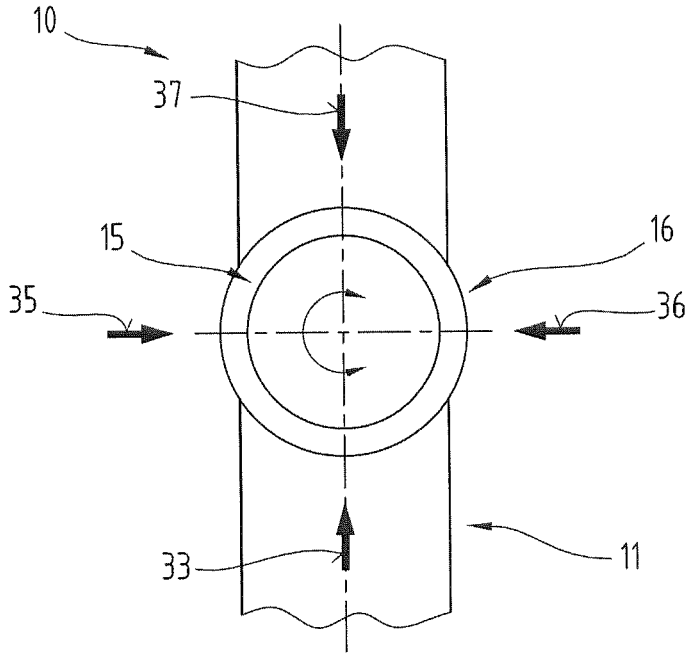
Figure 8:
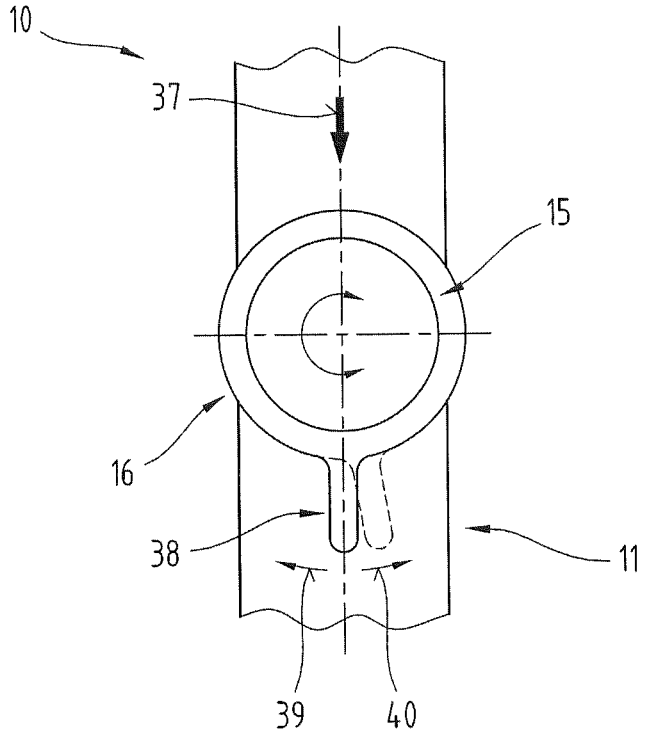
Figure 9:
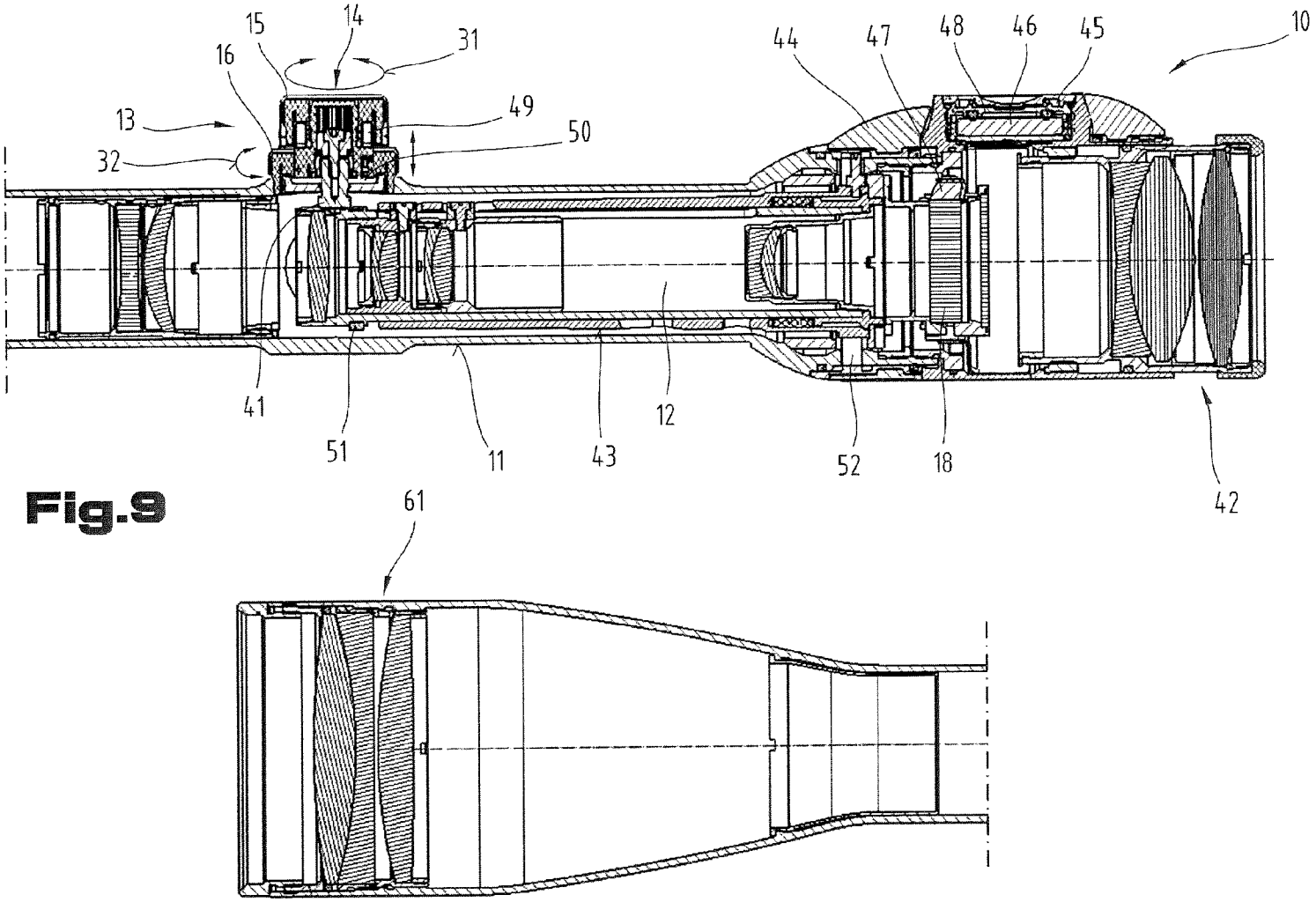

The heavily simplified schematics show:

FIG. 1 a schematic lateral view of a sighting device comprising tube, turret and adjusting elements disposed thereon according to a first exemplary embodiment;

FIG. 2 a target mark having a parameter display and variable target marks;

FIG. 3 a lateral view according to FIG. 1 of the sighting device;

FIG. 4 another exemplary embodiment of the adjusting device of the sighting device;

FIG. 5 a target mark of the sighting device for the sighting device according to FIG. 4;

FIG. 6 another exemplary embodiment of the sighting device with an alternative embodiment of the lower adjusting element;

FIG. 7 an alternative exemplary embodiment of the lower adjusting element of the sighting device according to FIG. 6;

FIG. 8 another embodiment of the lower adjusting element of the sighting device;

FIG. 9 a sighting device formed from a rifle sight shown in longitudinal section.

It must first be stated that in the various embodiments described, identical parts have been marked with the same reference identifiers and the same parts descriptions. It is therefore possible to transfer the disclosures contained in the overall description to the identical parts with the same reference identifiers or the same parts descriptions. The selected positioning terms are used in the description, such as top, bottom, side etc., which refer directly to the described and the depicted figures and which can be correspondingly transferred to the new position in the event of a change in position. Furthermore, individual characteristics or combinations of characteristics from the various embodiments shown and described can present independent or inventive solutions, or solutions according to the present invention.

FIG. 1 shows a sighting device 10 according to a first exemplary embodiment of the invention. The sighting device 10 exhibits an optical reversing system 12 in a tube 11, which reversing system 12 can be designed for constant or variable magnification. The reversing system 12 can be mechanically operated and manipulated via an adjustment device 13 (spindle). The person skilled in the art is familiar with the mechanical adjustment of the reversing system 12 (tilt), for which reason it will not be explained in more detail. Further, the sighting device 10 is designed to be mounted on a weapon, in particular on a rifle, for which reason the ballistics of fired ammunition is connected to in particular the sighting device 10. In the following, it will be assumed that the sighting device 10 is mounted on a rifle, not shown in the illustrations, for target acquisition.

The adjusting device 13 (spindle) is arranged in a turret 14 of the sighting device 10, the turret 14 being provided on the circumferential face of the tube 11. The illustration shows the turret 14 arranged in a drawing plane above the tube 11, which may, however, not necessarily suggest an elevation turret of a sighting telescope or a rifle sight. The shown turret 14 may also be a windage turret, but if this was the case, the illustration would show a top view of a sighting device 10. The design shown is thus provided to exemplarily point out the arrangement of the individual components with respect to one another.

The turret 14 essentially exhibits the adjusting device 13, by means of which not only the reversing system 12 can be operated, but also a ballistics computer, not shown. It is preferred that the ballistics computer is integrated in the sighting device, for which reason the sighting device is not required to provide a connection socket for connecting such a computer. It is however possible to provide a sighting device also offering a possibility to connect external components, in particular electrical and/or electronic components. A connection to one or several external devices via radio communication is also conceivable, and in this case, the sighting device 10 exhibits a transmitter and an antenna correspondingly.

In order for the reversing system 12 and the ballistics computer to be operated more easily, the adjusting device 13 is divided into sections, namely an upper adjusting element 15 and a lower adjusting element 16, and the positioning terms for the adjusting elements 15 and 16 refer to a positioning of the two components with respect to the tube 11. For a windage turret, also an upper and lower adjusting element would be provided corresponding to an elevation turret, even if those elements would actually be arranged side by side.

In order to allow a better differentiation and operation, the lower adjusting element 16 can have a greater diameter than the upper adjusting element 15 in order to allow a user to recognize the different adjusting elements 15 and 16 without even looking. It is alternatively or additionally conceivable that both of the adjusting elements 15 and 16 have different ribbings at their circumferential faces, whereby the different adjusting elements 15 and 16 may also become recognizable. The larger diameter of the lower adjusting element 16 furthermore allows a better handling, as it is arranged directly above the tube 11, meaning that there is less space for gripping the adjusting element 16. It is thereby also possible to prevent the upper adjusting element 15 from unintentionally being gripped and manipulated. The upper adjusting element 15 can be gripped from above, so that there is space in upward direction. For the lower adjusting element 16, there is only space in radial direction.

The two adjusting elements 15 and 16 are embodied as disc or ring, i.e. they have an annular contour as it is common for adjusting devices on rifle sights. The two adjusting elements 15 and 16 are mounted to rotate, and the individual element 15 and 16 may be rotated clockwise or counterclockwise for adjustment. This being the case, the adjusting elements 15 and 16 can also be operated and rotated independently of each other, as they are not mechanically coupled. The upper adjusting element 15 is mechanically connected to the reversing system 12. It is furthermore provided for the lower adjusting element 16 to be moved in respect of height additionally, in particular to be pushed down in an axial direction of the turret 14 in direction of the tube 11. It is furthermore possible for the ring of the adjusting element 16 as well to be moved or tilted in radial direction of the turret 14. This being the case, the lower adjusting element 16 is mounted to be moved in all three space levels in the turret 14.

The lower ring 16 in the turret 14 serves for operating the ballistics computer, for which reason the lower ring 16 is only provided for the electronic input of data into the ballistics computer and the operation of the latter. By means of the ring of the lower adjusting element 16 it is possible to enter different data relevant in terms of ballistics into the ballistics computer, in the event that the computer is not connected to the sensors which determine data relevant in terms of ballistics. The selection of the relevant data is not limited in the present exemplary embodiment, with the result that any relevant data may be processed by the ballistics computer. Exemplary but not finally, data that may be simply determined by the user of the sighting device should be noted at this point. The current range to the target is required for a correct target acquisition by means of the sighting device. Furthermore, also wind direction, wind speed, firing angle, assembly of the ammunition or suchlike may be entered manually.

The entered and optionally computed data are displayed in a display 17 in a reticute 18 of the sighting device. FIG. 2 shows such a display of a reticule 18. In the present example, the number "256" indicates the target range in meters, which number has either been entered manually via the lower adjusting element 16 or been transmitted to the ballistics computer by a range finder integrated in the sighting device. Other measurements, such as foot or yard are also possible.

The display 17 constitutes a part of a reticule or a target mark 19, with the help of which the target is acquired. The reticule shown has a crosshair having a centrally arranged aiming point 21 (which can also be referred to as target mark). Normally, the aiming point 21 is adjusted toward a center of a reticule to be zeroed in, and the target range shown in the display then corresponds to the predetermined range for zeroing. In addition to the aiming point 21 which is centrally arranged, further variable aiming points 20 are provided which are arranged to be below the first aiming point 21 in vertical direction.

By means of the target range, the ballistics computer is now capable of computing the zeroing range associated to the variable aiming points 20. Should this zeroing range deviate from a sighted in or determined zeroing range, the variable aiming points 20 are illuminated correspondingly. With the variable aiming points 20, that point would light in every case, at which point the zeroing range essentially corresponds to the determined or measured target range. If the target range entered by rotating the lower adjusting element 16 or measured by a sensor is increased, the correspondingly lower variable aiming point 20 will be illuminated. In the example shown in FIG. 2, the target range entered is 256 m, and the zeroing range calculated by the ballistics computer corresponds to the second variable aiming point 20. This means that the zeroing range determined for sighting in the weapon is less than 256 m.

By means of the sighting device 10 according to the invention it is possible for users or shooters shooting the black in spite of the possibility of the representation of an adapted zeroing range to manipulate (tilt) the revering system 12 according to the target range by means of the mechanic adjusting element 15. In order to make the centrally arranged aiming point 21 light up once the sighting device 10 has been adjusted, it is required for the position of the reversing system 12 to be measured and transmitted to the ballistics computer. This may either be carried out by means of a rotary pulse at a spindle in the turret 14 or by means of the position sensors directly at the reversing system 12. In accordance with the position of the reversing system 12, the corresponding aiming point 20, 21 would light up in the reticule 18.

It is furthermore also conceivable to design the reticule plate, the variable aiming points 20 and the display 17 shown as a joint graphic reticule.

Apart from displaying the target range, it also possible for the other mentioned data relevant in terms of ballistics to be shown in the display 17. It is additionally possible for other menu items of the ballistics computer to be also shown in the sighting field of the sighting device 10. For confirming the entry of individual data it is possible that the adjusting element is connected with a push button, so that e.g. the selection of the parameters or the end of an input of parameters is confirmed by additionally pushing the ring 16.

Should the aiming point 21 not be situated in the center of the crosshair and the reticule 18 not be positioned in the second image plane of the sighting device, this will also have an effect on the ballistic computing. It is therefore provided that the magnification which has been set is either entered into the ballistics computer manually or automatically measured and used by the latter.

It will probably be most comfortable for a shooter if the electronic adjusting element 16 is arranged at the elevation turret, as for the shooter this position is commonly connected to the adjustment of the zeroing range. It is nevertheless also conceivable that the electronic ring 16 is positioned to have a lateral position at the windage turret or opposite or at any other easily accessible position at the housing. If placed on a side opposite the windage turret, it may be combined with a parallax adjustment, if provided, or with a switch for reticule illumination, and it is, however, also possible to integrate this switch into the electronic ring 16.

According to a tactile feedback given by the upper adjusting element 15 when the reversing system 12 is adjusted by means of an integrated detent mechanism, a corresponding feedback is also provided for the lower adjusting element 16. The feedback can be given mechanically or electronically, and for electronic feedback either a sound is generated or the ring 16 is controlled in such a way that the user experiences a tactile feedback.

The invention relates to a sighting device having an adjusting device, which is preferably arranged on a turret of the sighting device and by means of which it is possible to mechanically control a reversing system as well as to electronically control a ballistics computer.

FIG. 3 shows how the adjusting device of the sighting device 10 can possibly be operated. Changing and entering the selection of parameters or relevant values is carried out by a rotary movement of the lower adjusting element 16. For acknowledgement of the entry, the adjusting element 16 is pushed in axial direction. This bears the advantage that adjusting and acknowledging may be performed without having to change the position of the hands.

FIG. 4 shows another embodiment of the adjusting device of the sighting device 10. Here, the illustration corresponds to a top view on the turret from above or in a direction parallel with respect to the rotary axis of the adjusting elements 15, 16. For operation, the upper adjusting element 15 of the adjusting device 13 has an operation direction according to a rotary movement 31. The same also applies to the lower adjusting element 16 which can be operated according to a rotary movement 32. Furthermore, it is provided for the lower adjusting element 16 that it may be moved back or forth by pushing within a limited adjustment path. This means that the lower adjusting element 16 exhibits a first push button movement 33 having a linear operation direction, which is oriented to be parallel with respect to the longitudinal direction of the sighting device 10. In the illustration according to FIG. 4, the push button movement 33 is illustrated by the lower adjusting element 16 being displaced forward with respect to its initial position or its rest position which is shown in dashed lines. In the opposite direction, the lower adjusting element 16 may be slid backwards by way of a push button movement 34, whereby a corresponding input may be made by the adjusting element 16. The push button movements 33, 34 cause this input by way of closing the corresponding electrical contacts or switching elements (not shown). This happens preferably under the effect of restoring forces counteracting the push button movements 33, 34, which may e.g. be generated by spring elements (not shown).

The sighting device 10 according to this exemplary embodiment further comprises the target mark 19 according to FIG. 5. In display 19 in the sighting field 18, also a designation of the respective parameter is shown additionally to the numerical value of the parameter to be set. The characters in the display 17 which are given as an example in FIG. 5, "DIST" and "256" represent the indication of the parameter "distance" having a value of "256 meters". By means of the lower adjusting element 16 according to FIG. 4, different kinds of different parameters may be entered in such a way that initially by pushing the adjusting element 16 according to the push button movement 33 a sequence of different parameters, according to a selection menu, is switched through step-by-step, and the currently set parameter appears in the display 17 of the target mark 19. In the same way, the current value of this parameter is shown in the display 17. When the desired parameter is reached, the value of the parameter can be changed by rotating the lower adjusting element 16, similarly, the changing value being shown in the display 17. As soon as the desired value of the parameter—according to the illustration in FIG. 5 the numerical value of the distance in meters—is achieved, the input can be acknowledged by pushing the lower adjusting element 16 according to the second push button movement 34, whereby the input of the parameter is accomplished. By further, repeatedly pushing the lower adjusting element 16, according to the push button movement 33, additional parameters may finally be selected to be entered and the input of desired values for these parameters is performed by analogy.

The FIG. 6 shows another exemplary embodiment of the sighting device 10 having an alternative design of the lower adjusting element 16. The adjusting element 16 according to this variant of embodiment also exhibits a disc or annularly shaped external design, but it is in this case not operated by rotation but by different push button movements. In addition to the adjustment path of the adjusting element 16 according to the push button movement 33, this adjusting element also exhibits operation directions or adjustment path in lateral direction with respect to the longitudinal extension of the sighting device 10. Thus, the adjusting element 16 can be pushed to the right hand side according to a push button movement 35, which is indicated in FIG. 6 by the adjusting element 16 correspondingly displaced to the right illustrated in dashed lines. On the other hand, the adjusting element 16 can be operated by being pushed to the left according to a push button movement 36. In accordance with this exemplary embodiment, the input of a desired parameters is to be carried out in such a way that by repeatedly pushing corresponding push button movements, the desired parameter is selected from a predetermined sequence (a menu) of parameters, which may correspondingly be recognized from the display 17 (FIG. 5). The value of the corresponding parameter can now by increased by pushing the adjusting element 16 to the right (according to push button movement 35), or reduced by pushing the adjusting element 16 to the left (according to push button movement 36). In the event of a continuous range of values of the parameters, the extent to which the numerical value is adjusted corresponds to the temporal period of pushing the adjusting element 16 according to a push button movement 35, 36. When the adjusting element 16 is pushed in forward direction or according to the push button movement 33, the input of the previously newly set parameter is similarly being accomplished thereby and the parameter selection is being switched one step further.

The FIG. 7 shows a further, alternative exemplary embodiment of the lower adjusting element 16 of the sighting device 10 according to FIG. 6. In this case, the adjusting element 16 also has a push button movement 37 in backward direction in addition to the push button movements 35, 36 in lateral direction and to the push button movement in forward direction 33. As an alternative to the embodiment according to FIG. 6, the accomplishment of the data input of a parameter is only carried out by pushing the adjusting element 16 in backward direction according to the push button movement 37, similar to an "acknowledgement key" or an "OK key".

The FIG. 8, finally, shows a further variant of embodiment of the lower adjustment element 16 of the sighting device 10, where the adjusting element 16 exhibits a lever 38 in addition to its disk-shaped basic design. It is possible to swivel the lower adjusting element 16 counterclockwise across a limited adjustment angle according to a swivel movement 39 and clockwise according to a swivel movement 40 by means of the lever 38. The adjusting element 16 additionally has a push button movement according to the push button movement 37. Using the adjusting element 16 according to this embodiment it is also possible to enter different parameters. For this purpose, the desired parameter is initially selected by pushing the adjusting element 16 in backward direction, i.e. according to the push button movement 37, which is shown in the display 17 (FIG. 5). If the designation of the parameter to be changed is shown in the display 17, the current value of the parameter can be increased or reduced by swiveling the lever 38 to the right (counterclockwise, according to illustration) or to the left (clockwise), respectively. In the event of parameters having a continuous range of values, the change of the value is effected according to the temporal period the lever 38 is swiveled into one or the other direction. In the event of a parameter having a discrete range of values, an adjustment can be performed step-by-step by repeatedly swiveling the lever 38 into the desired direction. The accomplishment of the input of a parameter is again effected by pushing the adjusting element 16 in backward direction according to the push button movement 37, whereby similarly the sequence of the parameters (in the menu) is being progressed one step further. For changing the value of a parameter by swiveling the lever 38, it is additionally possible for the adjusting element 16 to be designed in such a way that the speed at which the numerical value rises or decreases differs depending on the size of the swiveling angle of the swivel movements 39 or 40. It is in this case preferably provided that the restoring force acting against the pressure of the shooter's finger is initially smaller and is getting greater for increasing swiveling angles. Thus, the swivel movements 39, 40 of the adjusting element 16 provide a tactile feedback.

The FIG. 9 shows a longitudinal section through a sighting device 10 formed from a rifle sight. At its upper side, the tube 11 or the central tube of the rifle sight carries an adjusting device 13 formed from a turret 14, by means of which adjusting device 13 the reversing system 12 arranged inside the tube 11 can be adjusted in its relative position. For this purpose, the upper adjusting element 15 ("mechanical turret") has a spindle 41 which is in mechanical contact with the reversing system 12 and by means of which its relative position inside the tube 11 of the rifle sight 21 can be adjusted by swiveling. It is thereby possible for the aiming point 21 (FIG. 2) of the reticule 18 to be adjusted relative to an intermediate image generated of a remote object. The reticule 18 and the intermediate image generated of a remote object are looked at in a known manner through an eyepiece 42.

The reversing system 12 includes an internal tube 43, which serves as mechanical holding for the lenses arranged therein and causing the optical reproduction. According to the exemplary embodiment shown in FIG. 9, it is furthermore provided that the reversing system 12 allows a magnification which is adjustable in a predetermined range. For this purpose, two lenses of the reversing system 12 are configured to be capable of sliding in axial direction, and the magnification can be adjusted manually by a zoom adjustment 44. The optical reproduction of a remote object by the rifle sight is consequently performed by an objective lens 61 initially creating a first intermediate image in the first (lens-end) image plane. On the basis of the first intermediate image, the reversing system 12 then creates a second, upright intermediate image in the second (eyepiece-end) image plane.

In addition to the upper adjusting element 15, the turret 14 of the adjusting device 13 also exhibits an adjusting element 16 for operating a ballistics computer 45. As already explained in connection with the description of FIGS. 1 and 2, data may be entered into the ballistics computer 45 or functions may be controlled by means of this annularly designed adjusting element 16. For this purpose, the lower adjusting element 16 of the turret 14 is signal-connected to the ballistics computer 45. For the power supply—at least of the ballistics computer 45—a battery 46 is provided. The ballistics computer 45 is furthermore connected to a display 47, and its image can be directed or mirrored into the region of the image plane of the reticule 18, so that data entered into the ballistics computer and results computed by the ballistics computer, but also variable target marks can be shown together with the intermediate image of the remote object in the visual beam path. The ballistics computer 45 can, on the other hand, also be connected to an interface 48 for transmitting data via line or radio.

In order to allow the entries to be taken into consideration by the computer operations to be carried out by the ballistics computer 45, both of the adjusting elements 15 and 16 have sensors 49 and 50 by means of which the current positions or the rotary movements 31 or 32 can be caught as signals and transmitted to the ballistics computer 45. For capturing the relative position of the reversing system 12, it is alternatively or additionally possible that also a position sensor 51 is provided. It is preferred that also a sensor 52 for capturing the magnification or the zoom adjustment of the rifle sight is provided and also signal-connected to the ballistics computer.

The embodiments illustrated as examples represent possible variants of the sighting device 10 or its adjusting elements 15, 16, and it should be pointed out at this stage that the invention is not specifically limited to the variants specifically illustrated, and instead the individual variants may be used in different combinations with one another and these possible variations lie within the reach of the person skilled in this technical field given the disclosed technical teaching. Accordingly, all conceivable variants which can be obtained by combining individual details of the variants described and illustrated are possible and fall within the scope of the invention.

For the sake of good order, finally, it should be pointed out that, in order to provide a clearer understanding of the design of the sighting device 10, it and its constituent parts are illustrated to a certain extent out of scale and/or on an enlarged scale and/or on a reduced scale.

The objective underlying the independent inventive solutions may be found in the description.

Above all, the individual embodiments of the subject matter illustrated in FIGS. 1; 2; 3, 4; 5; 6; 7; 8 and 9 constitute independent solutions proposed by the invention in their own right. The objectives and associated solutions proposed by the invention may be found in the detailed descriptions of these drawings.

LIST OF REFERENCE NUMERALS

10 Sighting device
11 Tube
12 Reversing system
13 Adjusting device
14 Turret
15 Adjusting element
16 Adjusting element
17 Display
18 Reticule
19 Target mark
20 Aiming point
21 Aiming point
31 Rotary movement
32 Rotary movement
33 Push button movement
34 Push button movement
35 Push button movement
36 Push button movement
37 Push button movement
38 Lever
39 Swivel movement
40 Swivel movement
41 Spindle
42 Eyepiece
43 Internal tube
44 Zoom adjustment
45 Ballistics computer
46 Battery
47 Display
48 Interface
49 Sensor
50 Sensor
51 Position sensor
52 Sensor
61 Objective

The invention claimed is:

1. A rifle sight comprising:

a tube and an optical reversing system inside said tube, the optical reversing system comprising an internal tube with lenses arranged therein for reproducing and erecting a first intermediate image into a second intermediate image, and a turret with a spindle by means of which said optical reversing system is mechanically adjustable in its relative position inside said tube;

a crosshair;

and a ballistics computer for computing data relevant in terms of ballistics;

and a display for the indication of at least one variable aiming point, wherein the at least one variable aiming point can be adjusted electronically, wherein said turret comprises a second adjusting element for adjusting the at least one variable aiming point and for entering data into said ballistics computer, and wherein the second adjusting element exhibits a disc or annularly shaped external design and is arranged coaxially to an axis of rotation of the spindle and exhibits an operation direction according to a rotary movement with an axis of rotation arranged to be parallel with respect to the axis of rotation of the spindle.

2. The rifle sight according to claim 1, wherein said spindle and said second adjusting element are arranged to be directly adjacent to each other.

3. The sighting device according to claim 2, wherein at least one of the spindle or second adjusting elements is capable of being rotated, tilted and height adjusted at the same time.

4. The rifle sight according to claim 1, wherein said spindle and said second adjusting element can be operated independently of each other.

5. The rifle sight according to claim 1, wherein said spindle and said second adjusting elements are arranged on an elevation turret or on a windage turret of the rifle sight.

6. The rifle sight according to claim 1, wherein said spindle and said second adjusting element are arranged on the respective turret one above the other in axial direction of the turret and said second adjusting element is arranged below a top end of said spindle with respect to a tube of the rifle sight, wherein said second adjusting element has a greater circumference than said spindle.

7. The rifle sight according to claim 1, wherein once the data has been entered, the data is acknowledged by operating said spindle or said second adjusting elements.

8. The rifle sight according to claim 1, wherein said second adjusting element is capable of entering data selected from the group consisting of a target range, wind direction, wind speed, firing angle, and assembly of the ammunition into the ballistics computer as data being relevant in terms of ballistics.

9. The sighting device according to claim 1, wherein the at least one target mark can be adjusted by means of the ballistics computer.

10. The sighting device according to claim 1, wherein several target marks are provided, which can be illuminated each alone or at least partially together.

11. The sighting device according to claim 10, wherein the target marks can be illuminated depending on the ballistic data entered or computed.

12. The sighting device according to claim 10, wherein the target marks can be illuminated depending on the position of the optical reversing system, wherein the position of the optical reversing system is captured by a position capturing device and is transmitted to the ballistics computer to the ballistics computer.

13. The sighting device according to claim 10, wherein the target marks are adjustable depending on a predetermined magnification of the sighting device, the computation of the data relevant in terms of ballistics is carried out depending on the magnification.

14. The sighting device according to claim 13, wherein the data relevant in terms of ballistics, can be displayed within the at least one target mark.

15. The rifle sight according to claim 1, wherein the second adjusting element is designed for the electronic input of data and said second adjusting element exhibits an operation direction according to a rotary movement for the input of data.

16. The sighting device according to claim 15, wherein the spindle exhibits a push button movement having a linear operation direction which is arranged to be vertical with respect to the axis of rotation of the spindle.

17. The rifle sight according to claim 15, wherein said second adjusting element exhibits a push button movement having a linear operation direction which is arranged to be parallel to the axis of rotation of said spindle.

18. The sighting device according to claim 15, wherein the spindle is designed to be substantially disc-shaped and additionally exhibits a lever, the spindle exhibiting an operation direction according to a swivel movement having a limited adjustment angle.

19. The rifle sight according to claim 1, wherein at least an image of an alphanumeric display is comprised in a visual beam path of the display.

* * * * *